US007351187B2

(12) United States Patent
Seliber

(10) Patent No.: US 7,351,187 B2
(45) Date of Patent: Apr. 1, 2008

(54) RESISTANCE AND POWER MONITORING DEVICE AND SYSTEM FOR EXERCISE EQUIPMENT

(76) Inventor: Joseph Seliber, 724 Farringdon La., Burlingame, CA (US) 94010

( * ) Notice: Subject to any disclaimer, the term of this patent is extended or adjusted under 35 U.S.C. 154(b) by 7 days.

(21) Appl. No.: 11/584,076

(22) Filed: Oct. 20, 2006

(65) Prior Publication Data

US 2007/0197346 A1 Aug. 23, 2007

Related U.S. Application Data

(60) Provisional application No. 60/729,353, filed on Oct. 22, 2005.

(51) Int. Cl.
*A63B 21/06* (2006.01)

(52) U.S. Cl. ..... 482/63; 482/58; 482/6

(58) Field of Classification Search ..... 482/53, 482/57–58, 62–65; 415/122.1, 123, 124, 415/124.2; 416/169 R, 170 R, 173, 197 C; *A63B 22/04, A63B 22/06*

See application file for complete search history.

(56) References Cited

U.S. PATENT DOCUMENTS 3,955,365 A 5/1976 Arao
4,358,105 A * 11/1982 Sweeney, Jr. ..... 482/5
4,403,974 A 9/1983 Sherman
4,645,199 A 2/1987 Bloemendaal
4,741,529 A 5/1988 Bloemendaal
4,768,782 A 9/1988 Blackburn
4,768,783 A 9/1988 Engalitcheff
5,211,613 A 5/1993 Friesl
5,331,811 A 7/1994 Giberson
5,460,585 A 10/1995 Gentry
5,810,696 A * 9/1998 Webb ..... 482/52
5,938,551 A 8/1999 Warner
5,944,637 A 8/1999 Stickler
6,808,472 B1 10/2004 Hickman
6,856,934 B2 2/2005 Vock
6,869,384 B2 3/2005 Shui
6,902,515 B2 6/2005 Howell
6,945,917 B1 9/2005 Baatz
7,097,596 B2 8/2006 Yang

* cited by examiner

*Primary Examiner*—Terrence R. Till
*Assistant Examiner*—Ryan Durcik
(74) *Attorney, Agent, or Firm*—Patrick Reilly

(57) ABSTRACT

An exercise device includes pedals, a belt and a hydrokinetic brake. A user applies muscular force to the pedals and the pedal belt transfers the motion of the pedals to a flywheel shaft of the fluid brake. The pedals may be configured to accept force from a hand, foot, arm, leg and/or neck of the user. The amount of work performed by the user is derived by measuring the relative rotational speeds of two radial-blade impellers of the fluid brake. The wattage exhibited by the fluid brake during the exercise session may be recorded and associated with an identified user, whereby records of the exercise performance of an individual may be updated.

20 Claims, 8 Drawing Sheets

RESISTANCE AND POWER MONITORING DEVICE AND SYSTEM FOR EXERCISE EQUIPMENT

CO-PENDING APPLICATION

The present invention is a continuation-in-part of U.S. Provisional Patent Application Ser. No. 60/729,353, entitled "Braking and power indicating system for stationary indoor bicycles and other cardio-vascular training exercise (sic) equipment", and filed on Oct. 22, 2005. Aforementioned U.S. Provisional Patent Application Ser. No. 60/729,353 is hereby incorporated in its entirety and for all purposes in this patent application. The priority filing date of October 22$^{nd}$ is claimed U.S. Provisional Patent Application Ser. No. 60/729,353 for this nonprovisional patent application.

FIELD OF THE INVENTION

The present invention relates the field of physical fitness equipment. More particularly, the present invention relates to exercise equipment that enables an assessment of the exercise effort performed by a user.

BACKGROUND OF THE INVENTION

Sufficient exercise and an appropriate diet are recognized as being necessary for building and retaining good health. Unfortunately a majority of Americans, while knowing these facts, are unable to practice these healthy habits. The federal Center for Disease Control in Atlanta has recently announced that 60% percent of Americans do not exercise enough. A similar number of Americans are either overweight or obese. One of the results of this is that health costs in the US exceed that of most of the industrialized nations of the world. Recent information has shown that not only is aerobic exercise necessary, but that strength training also has very significant health benefits. The present invention is designed to facilitate motivating Americans, especially the employees of large corporations and other organizations, to exercise regularly and eat property. These two factors must be present, and by comparing the exercise metrics and a number of medical measurements the system can evaluate users' and participants' compliance with the dietary protocol.

The key to this shift in behavior will be the introduction of a compact, moderate cost, exercise device which will be able to generate and transmit electronic data accurately showing the watts and calories generated by the user. This data will distinguish between cardio-vascular and strength training for the individual. At the present time there is no modest cost, compact equipment capable of doing this. There are a large number of simple exercise devices on the market, but none of these are able to produce the electronic data necessary to accurately quantify and transmit the efforts of the exerciser to a distant location.

It is well known that the human body responds relatively quickly, in a matter of months, to regular exercise and an appropriate diet. Organization employees who use this device in their homes will be given a financial reward; a reduction in the cost of their health insurance, if they meet the requirements of a medically established protocol designed especially for their age and other individual characteristics. Their reward is based upon the fact that their biological age will actually be significantly lower than their chronological age as a result of performing the required exercise. Their health maintenance costs will be markedly lower.

The basis of this unique exercise device is the hydrokinetic fluid coupling. This type of fluid coupling can act as a brake or clutch, and in either mode it provides a resistance to motion that needs only a speed sensor to accurately provide the instantaneous watts generated by the user. Given the duration of the exercise in fractions of a second, of the fluctuating watts (power) generated by the human muscle, the device accurately provides calorie information of the exercise performed. This invention incorporates a variety of frames and configurations that can be used with this compact, fluid device which is capable of creating a wide range of resistance.

Patented prior art which relates to this invention includes Friesl U.S. Pat. No. 5,211,613 which illustrates an indoor cycle which uses a fan as the resistance producing means. This device limits the user to a fixed resistance for any particular cadence. Warner U.S. Pat. No. 5,938,551 demonstrates an upper body cycle utilizing a fan which has a variable pitch pulley system, and improves on Friesl by allowing the user to vary the resistance at any particular cadence. This system makes no claim to measure the watts of resistance only the movement of a potentiometer which can only indicate the level of difficulty. It would be necessary to include the cadence or some other fan speed indicator to allow the calculation of watts. This device has no means for lower body exercise. U.S. Pat. Nos. 4,645,199 and 4,741,529 Bloemendaal uses a viscous shear fluid brake to provide resistance. The method of Bloemendall of creating resistance is hampered by the effect of heat which causes an uncontrolled change in resistance due to the change in viscosity of fluid. There is no mention of providing the user with an accurate watts value.

The two key habits of sufficient exercise and healthy dietary practices can lead to significant health improvements; the automated tracking of exercise performance and other health metrics, e.g., body weight, body fat, and body measurements can be used to evaluate a participant's compliance with a recommended dietary protocol. Monitoring the exercise behavior of participants in an exercise regimen by means of information technology further provides the potential for improving the compliance of the participants by enabling health improvement tracking and associated reward programs. When compliance with an exercise program is sustained, the participants of the program may reduce their individual biological ages and thereby reduce their individual need for medical services. Employers and health insurers of compliant participants may thereby experience reduced medical expenditures.

The prior art has introduced numerous exercise machines that attempt to conveniently enable exercise. Yet the prior art fails to provide an exercise device that optimally provides the opportunity to selectively engage in exercise intensity and that generates information in an electronic format accessible to information technology systems.

Prior art devices allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical.

Prior art exercise equipment employs various methods of providing resistance against which a user applies muscular force, as well as equipment for monitoring athletic effort expended by the user. Other relevant prior art examples include U.S. Pat. No. 4,403,974 (Inventors Sherman, et al.), issued on Sep. 13, 1983, discloses a position control mechanism for a variable drive ratio pulley system; U.S. Pat. No. 4,768,783 (Inventor Engalitcheff, Jr.), issued on Sep. 6, 1988, discloses an apparatus for the rehabilitation of damaged limbs; U.S. Pat. No. 5,331,811 (Inventor Giberson), issued on Jul. 26, 1994, discloses a fluid drive; U.S. Pat. No. 3,955,365 (Inventor Arao), issued on May 11, 1976, discloses a fluid drive apparatus; U.S. Pat. No. 7,097,596 (Inventor Yang) filed on Aug. 29, 2006 discloses an exercise bicycle; U.S. Pat. No. 6,945,917 (Inventor Baatz) issued on Sep. 20, 2005 discloses a resistance exercise apparatus and trainer; U.S. Pat. No. 6,902,515 (Inventors Howell, et al.) issued on Jun. 7, 2005 discloses a multi-functional exercise apparatus; U.S. Pat. No. 6,869,384 (Inventor Shui) issued on Mar. 22, 2005 discloses an exercising bicycle; U.S. Pat. No. 6,856,934 (Inventors Vock, et al.) issued on Feb. 15, 2005 discloses sport monitoring systems and associated methods; U.S. Pat. No. 5,944,637 (Inventors Stickler, et al.) issued on Aug. 31, 1999 discloses a modular fluid resistance unit for bicycle training equipment; and U.S. Pat. No. 6,808,472 (Inventor Hickman) issued on Oct. 26, 2004 discloses a method and apparatus for remote interactive exercise and health equipment.

The entire disclosures of each and every patent mentioned in this present disclosure, to include U.S. Pat. Nos. 4,403,974; 5,331,811; 3,955,365; 5,211,613; 5,938,551; 4,645,199; 4,741,529; 4,768,783; 7,097,596; 6,945,917; 6,902,515; 6,869,384; 6,856,934; 5,944,637; 6,808,472 as noted above, are incorporated herein by reference and for all purposes.

Yet the prior art fails to optimally apply fluid braking technology to exercise equipment. In addition, the prior art fails to optimally distinguish aerobic from anaerobic exercise on the basis of an observed cadence of exercise and wattage exhibited by an exercise device

OBJECTS OF THE INVENTION

It is an object of the present invention to provide an exercise device to improve physical fitness.

It is an additional object of certain alternate preferred embodiments of the method of the present invention to enable quantification, monitoring and recording of the exercise activity of a user of an exercise device.

SUMMARY OF THE INVENTION

Towards these and other objects that will be made obvious in light of the present invention, an exercise device including a frame, a drive and a hydrokinetic brake is provided. Muscular force applied by a user of the exercise device is translated via the drive into rotational motion of the hydrokinetic brake.

In certain alternate preferred embodiments of the method of the present invention, an information technology system may analyze data received from an exercise equipment that includes a hydrokinetic brake, and distinguish aerobic from strength building exercise on the basis of an observed cadence of exercise and wattage exhibited by an exercise device.

The hydrokinetic brake includes a housing, an inner impeller and a liquid medium. The housing is rotatably coupled with the frame. The housing includes a radial-blade impeller that transfers force to the liquid medium as the housing rotates by virtue and affect of flow of the liquid medium as affected by radial-blades of inner impeller. The inner impeller is rotatably coupled with the housing and includes one or more radial-blades and a shaft. The inner impeller shaft extends through the housing and may be (1.) statically affixed to the frame, or (2.) rotatably coupled with the frame. Where the inner impeller shaft is rotatably coupled with the frame, a disc or other load may be attached to the inner impeller shaft.

Certain alternate preferred embodiments of the present invention include or are coupled with a drive having pedals and/or an upper body linkage configured to enable a user to apply muscular force to the device for translation into rotational motion of the housing and/or the inner impeller.

Certain still alternate preferred embodiments of the method of the present invention provide a computational system that includes sensors for measuring wattage exhibited by the fluid brake, and optionally for recording the wattage expended in an electronic media.

Certain various still alternate preferred embodiments of the method of the present invention include or are coupled with a drive comprising (1.) a flywheel, (2.) intermediate pulleys, (3.) belts, (4.) gearing, and/or other suitable elements for translating muscular energy of the user into rotational motion of the fluid brake.

The foregoing and other objects, features and advantages will be apparent from the following description of the preferred embodiment of the invention as illustrated in the accompanying drawings.

BRIEF DESCRIPTION OF THE DRAWINGS

These, and further features of the invention, may be better understood with reference to the accompanying specification and drawings depicting the preferred embodiment, in which.

DETAILED DESCRIPTION OF PREFERRED EMBODIMENTS

In describing the preferred embodiments, certain terminology will be utilized for the sake of clarity. Such terminology is intended to encompass the recited embodiment, as well as all technical equivalents, which operate in a similar manner for a similar purpose to achieve a similar result.

Figure 1:
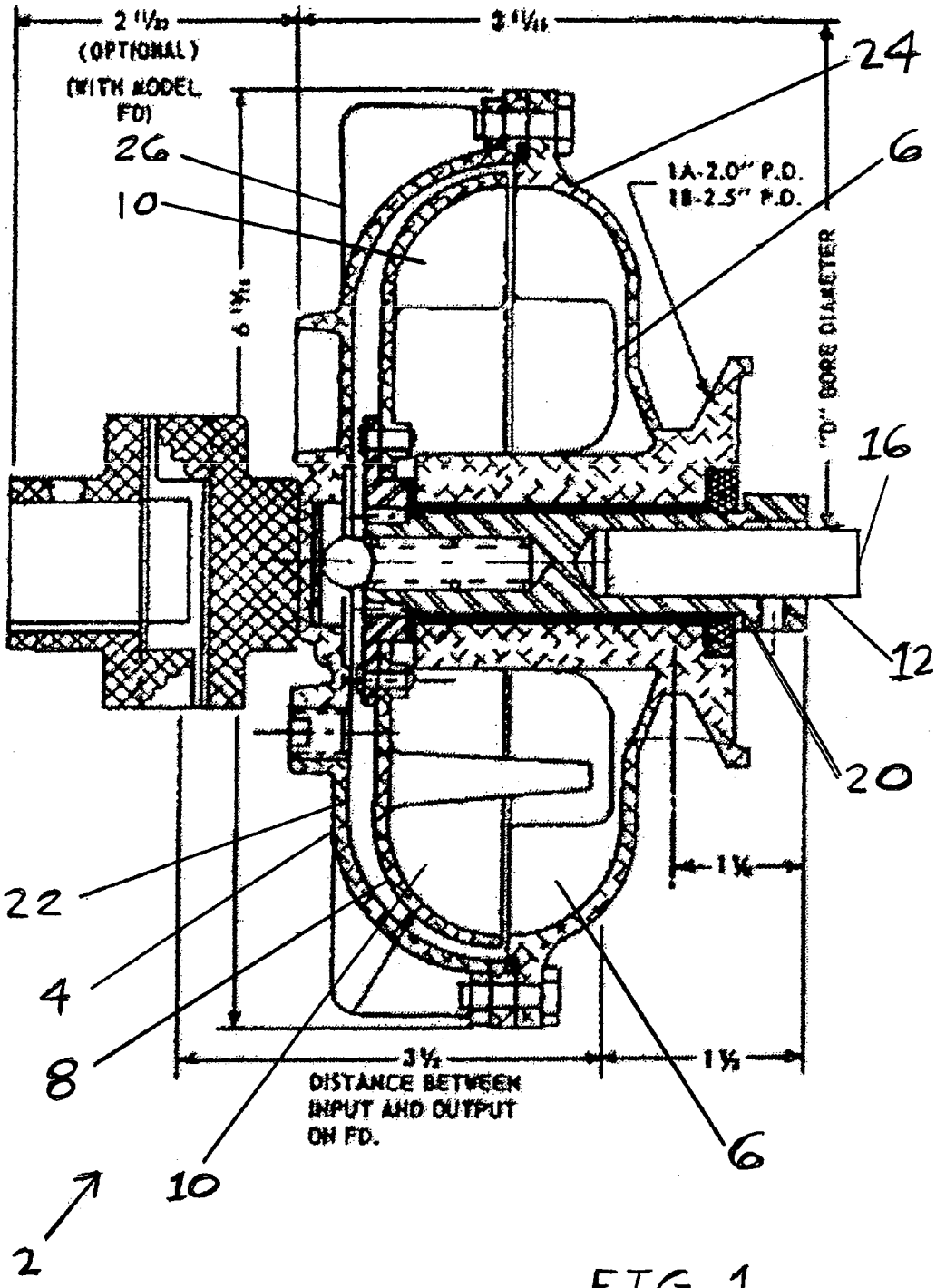
FIG. 1 is an illustration of a hydro-kinetic brake.

Referring now generally to the Figures and particularly to FIG. 1, FIG. 1 is an illustration of a hydro-kinetic brake 2. The brake 2 includes a housing 4, a liquid medium 6 and an inner impeller 8. The inner impeller 8 includes a plurality of radial blades 10 affixed to an inner impeller shaft 12. The inner impeller shaft 12 extends through a sleeve bearing 14 of the housing 4. An external end 16 of the inner impeller shaft 12 may be (1.) affixed to a frame 18 (see FIG. 2A) by welding, pinning, or other suitable fixed attachment means known in the art, whereby the housing 4 may rotate about the inner impeller shaft 12; or (2.) rotatably coupled to the frame 18 by a sleeve bearing 20 or other suitable rotatable attachment means known in the art. The housing 4 is thereby rotatably coupled with the frame 18 by either of these two means, or other suitable attachment means known in the art.

The housing 4 comprises the bearing 14 and a body 22. The housing body 22 includes a plurality of housing radial blades 24 and radiator fins 26. The radiator fins 26 transfer heat from the brake 2 to the environment surrounding the brake 2, whereby the brake 2 may be air cooled. The housing radial blades 24, when in motion relative to the liquid medium 6, interacts with the liquid medium 6 to transfer force. Similarly, the inner impeller radial blades 10 also interact with the liquid medium 6 to transfer force, whereby the inner impeller blades 10 and the housing radial blades 24 transfer force back and forth via the medium of the liquid medium 6. The liquid medium 6 may be a low viscosity liquid, such as a suitable natural oil, synthetic oil or other suitable liquid known in the art.

Figure 2A:
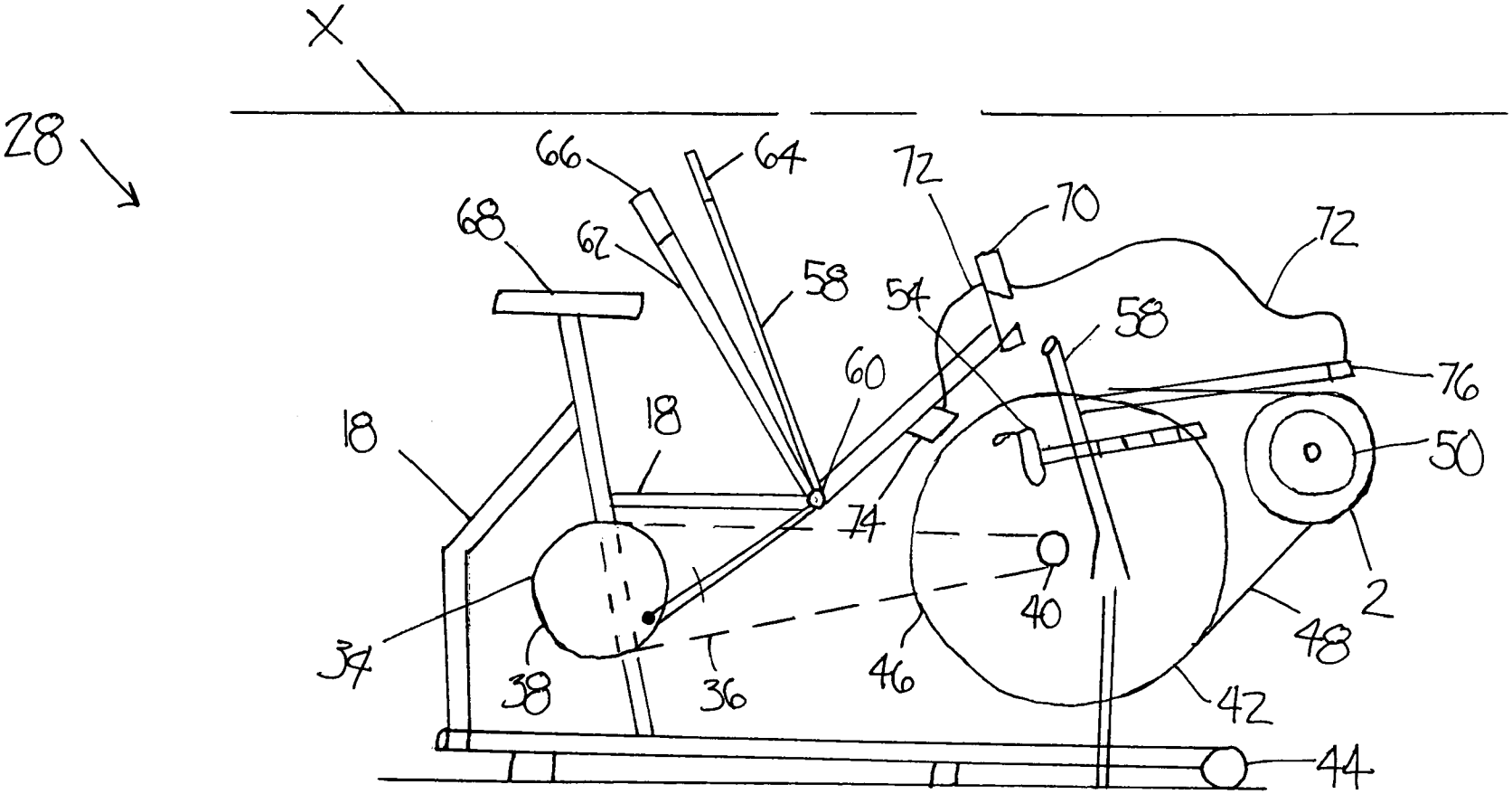
FIG. 2A is a side view illustration of an exercise bicycle embodiment of the present invention having a fixed inner impeller.
Figure 2B:
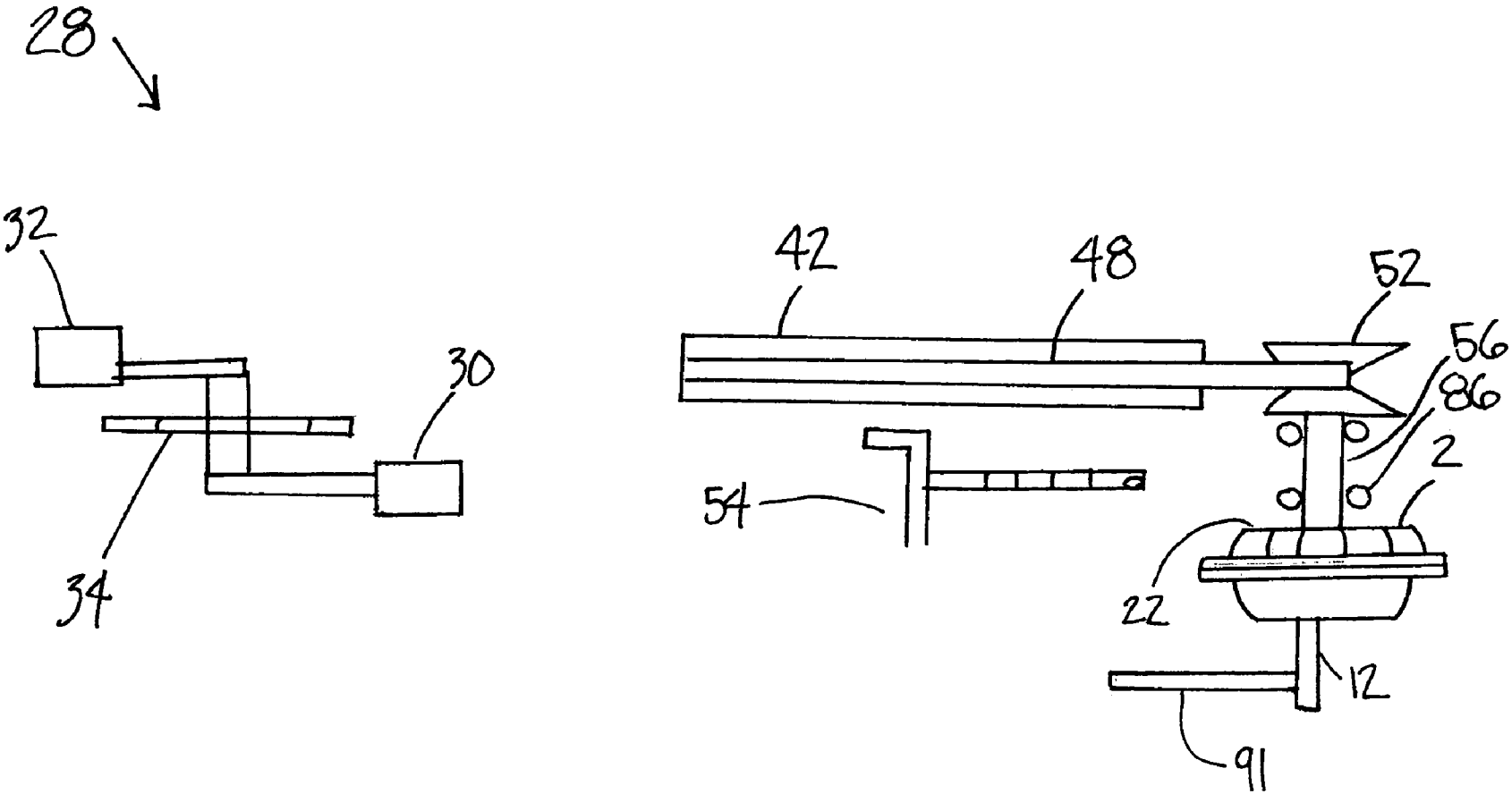
FIG. 2B is a top view illustration of the exercise bicycle embodiment of the present invention of FIG. 2B.

Referring now generally to the Figures and particularly to FIGS. 2A and 2B, FIG. 2 is a side view of an illustration of an exercise bicycle embodiment of the present invention 28, or first version 28, having a hydro-kinetic brake 2 (hereafter "brake" 2) of FIG. 1; and FIG. 2B is a top view of the first version 28. The inner impeller shaft 12 of the brake 2 is affixed to the bicycle frame 18 by welding or other suitable means known in the art.

The brake 2 may be or comprise a FLUID DRIVE MODEL FV (™) fluid brake marketed by Fluid Drive Engineering Co. of Post Office Box PO117879, Burlingame, Calif. 94011-7879 and/or a FLUID DRIVE MODEL FD (™) fluid brake also marketed by Fluid Drive Engineering Co. of Post Office Box PO117879, Burlingame, Calif. 94011-7879, or other suitable fluid brake or fluid coupling known in the art. A pedals 30 & 32 are each attached to a pedal wheel 34. The pedal wheel 34 is rotatably coupled to the bicycle frame 18 by suitable means known in the art. A pedal coupling drive belt 36 rides along an outer diameter 38 of the pedal wheel 34 and transfers mechanical force from the pedal wheel outer diameter 38 to a sprocket 40 of a flywheel 42. The flywheel 42 is rotatably coupled to the frame 18 by suitable means known in the art.

The pedal wheel 34 may be a cog or sprocket and the pedal coupling drive belt 36 may be a gearing, a toothed belt, a V belt, or a chain configured to engage with the pedal wheel 34 and the flywheel sprocket 40 to transfer rotational force from the pedal wheel 34 to the flywheel 42.

The flywheel 42 includes an outer flywheel diameter 46 positioned about the flywheel sprocket 40. The flywheel diameter 46 is coupled with a transmission coupling drive belt 48 of a variable ratio transmission 50. The variable ratio transmission 50 comprises a variable pitch pulley 52 rotatably coupled with the frame 18. The variable pitch pulley 52 may be or comprise a suitable ECONOLINE SERIES ™ variable pitch pulley or ADJUSTA-SHEAVE ™ variable pitch pulley, both marketed by Lovejoy, inc. of 2655 Wisconsin Avenue, Downers Grove, Ill. 60515.

The variable ratio transmission 50 is configured to transfer force from the drive to rotational movement of the brake housing 4.

An adjustment arm 54 of the variable ratio transmission 50 enables a user to vary the ratio of the variable pitch pulley 52 at which the transmission coupling drive belt 48 engages the variable pitch pulley 52. The transmission coupling drive belt 48 may be a gearing, a toothed belt, a V belt, or a chain configured to engage with the variable pitch pulley 52 and the flywheel diameter 46. A housing shaft 56 of the brake housing 4 is coupled with the variable pitch pulley 52 whereby rotational motion of the variable pitch pulley 52 is imposed onto the housing 4 and the housing 4 is driven by the variable pitch pulley 52.

The first version 28 may further comprise upper body linkages 58 & 62. The upper body linkages 58 & 62 are rotatably coupled to a rotatable attachment feature 60 of the frame 18. The upper body linkage 58 is further rotatably coupled to the pedal wheel 34. The upper body linkage 58 & 62 are configured to enable a user to rotate the pedal wheel 34 by applying muscular force to a pair of handles 64 & 66 substantially along an X axis, whereby the muscular force is translated to rotational movement of the pedal wheel 34.

The user may sit on a seat 68 and apply muscular force to one or both pedals 32 to cause rotation of the pedal wheel 34 while optionally, alternatively and/or simultaneously applying muscular FORCE to one or more handles 64 & 66.

The first version 28 further comprises a computer 70 communicatively coupled by means of signal wires 72 with a first sensor 74 and a second sensor 76. The first sensor 74 is attached to the frame 18 and is configured to detect a speed of rotation of the pedal wheel 34 to the computer 70. The second sensor 76 is attached to the frame 18 and is configured to detect a speed of rotation of the brake housing 4 to the computer 70.

Figure 3A:
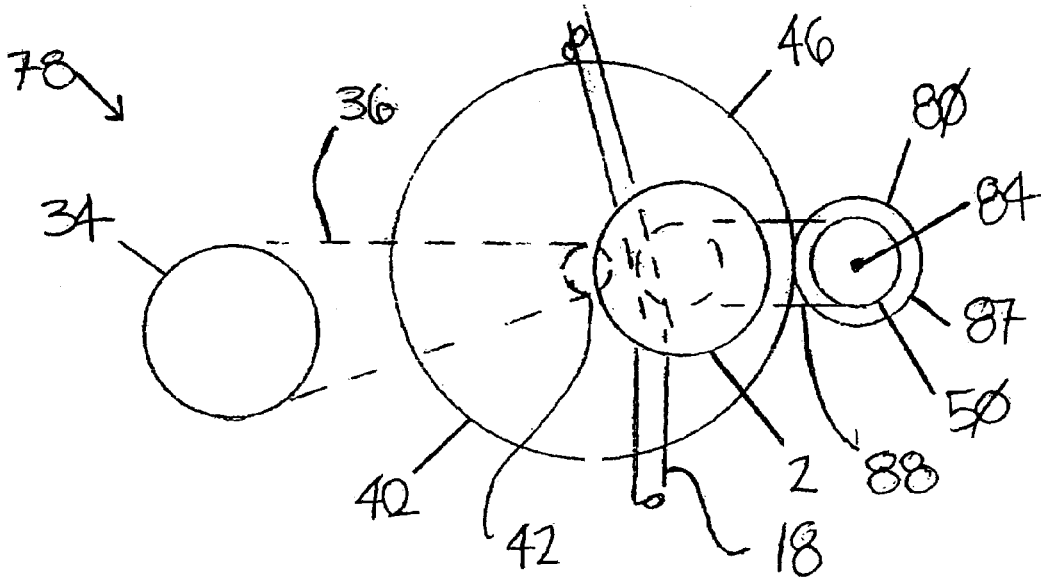
FIG. 3A is a side view illustration of a variation of the device of FIG. 2.
Figure 3B:
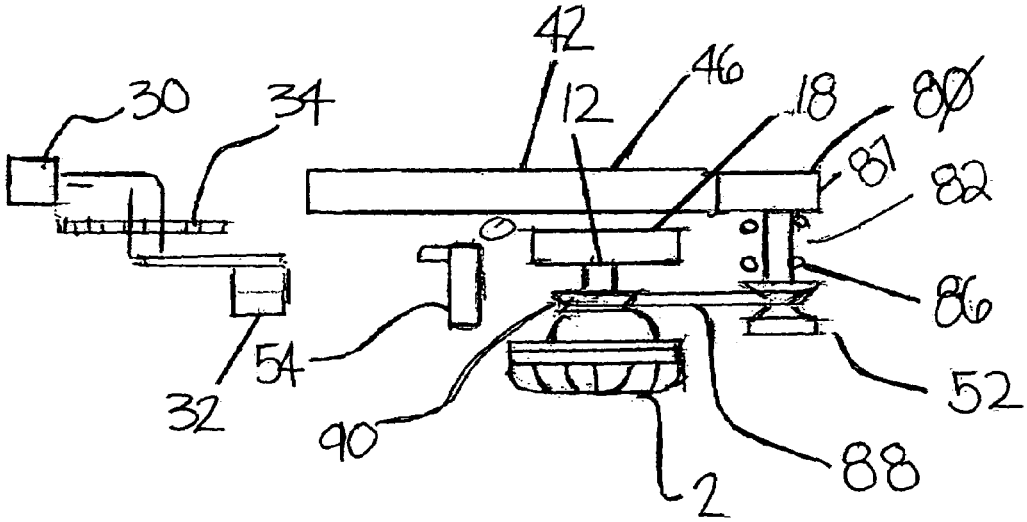
FIG. 3B is a top view illustration of device of FIG. 3A.

Referring now generally to the Figures and particularly to FIGS. 3A and 3B, FIG. 3A is a side view illustration of a second preferred embodiment of the present invention 78, or second version 78; and FIG. 3B is a top view of the second version 78. The second version 78 is a variation of the first version 28 of FIG. 2, and includes the frame 18, the pedals 30 & 32, the pedal wheel 34, the pedal coupling drive belt 36, the flywheel 42, the variable ratio transmission 50, and the brake 2. The second version 78 further comprises an intermediate wheel 80 rotatably coupled with the frame 18. The intermediate wheel 80 translates rotational motion of the outer flywheel diameter 46 to the variable ratio pulley 52 by means of a pulley shaft 82. The intermediate wheel 80 is rotatably coupled with rotates about a third attachment feature 84 of the frame 18. The pulley shaft 82 extends through an intermediate ball bearing assembly 86 of the intermediate wheel 80. The frame attachment feature 84 is positioned relative to the flywheel 42 to cause the outer flywheel diameter 46 to transfer rotational force to the intermediate wheel by direct physical contact with an intermediate wheel outer surface 87.

The second version 78 further comprises a coupling drive belt 88, wherein the coupling drive belt 88 mechanically couples the variable pitch pulley 52 with a brake housing pulley 90 whereby a rotational force is transferred from the rotation of the variable pitch pulley to cause rotation of the brake housing 4. The housing shaft 56 may be or comprise a cog or sprocket and the coupling drive belt 88 may be a gearing, a toothed belt, a V belt, or a chain configured to engage with the variable pitch pulley 52 and the housing shaft/to transfer rotational force from the variable pitch pulley 52 to the housing and to the locked inner impeller shaft 12. A pin 91 extending from the inner impeller shaft 12 presses against the frame 18 and restrains rotation of the inner impeller 8.

Figure 4A:
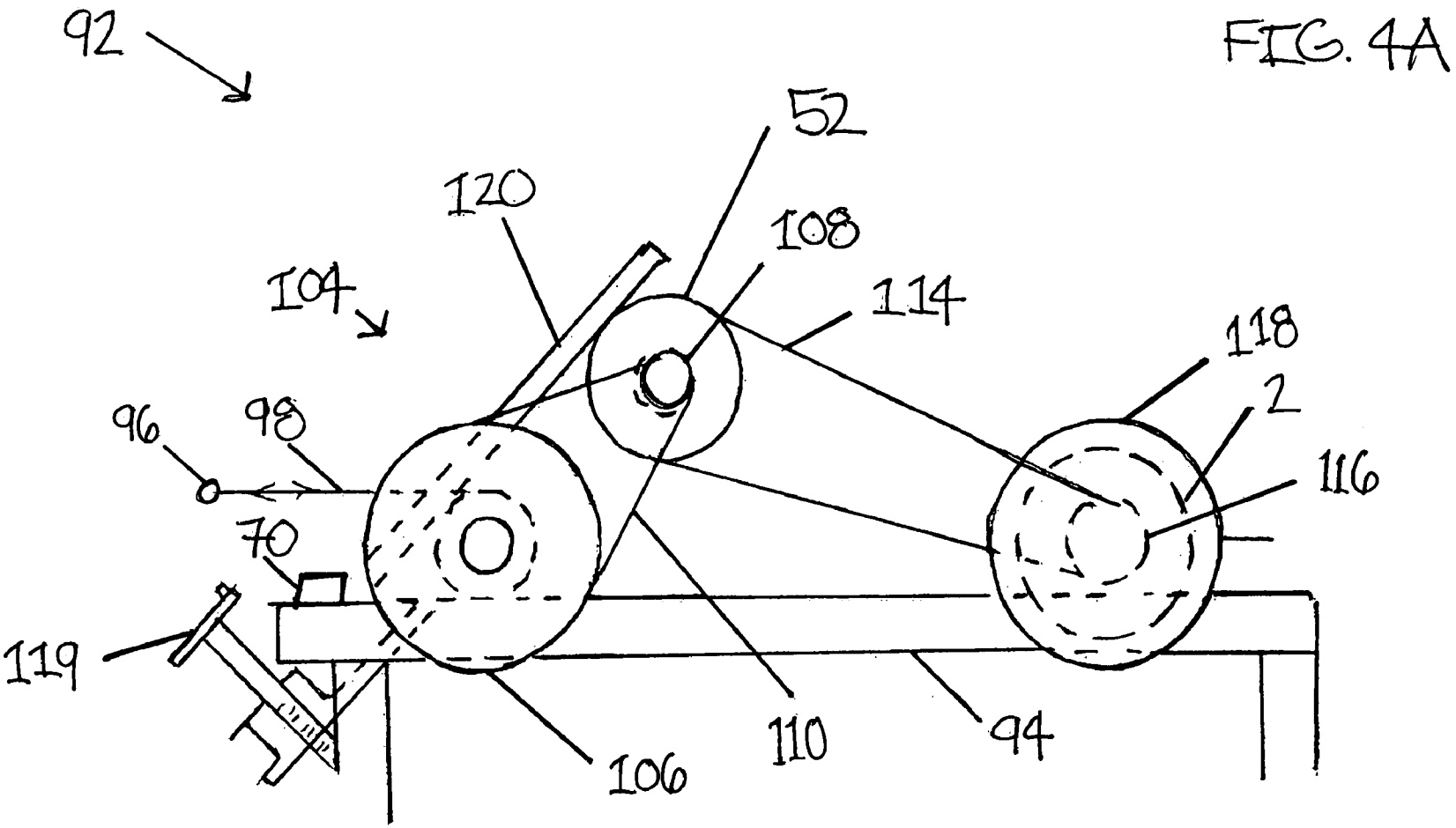
FIG. 4A is a side view illustration of a still alternate preferred embodiment of the present invention, wherein the inner impeller of FIG. 1 may rotate relative to the housing and is loaded with an inertial.
Figure 4B:
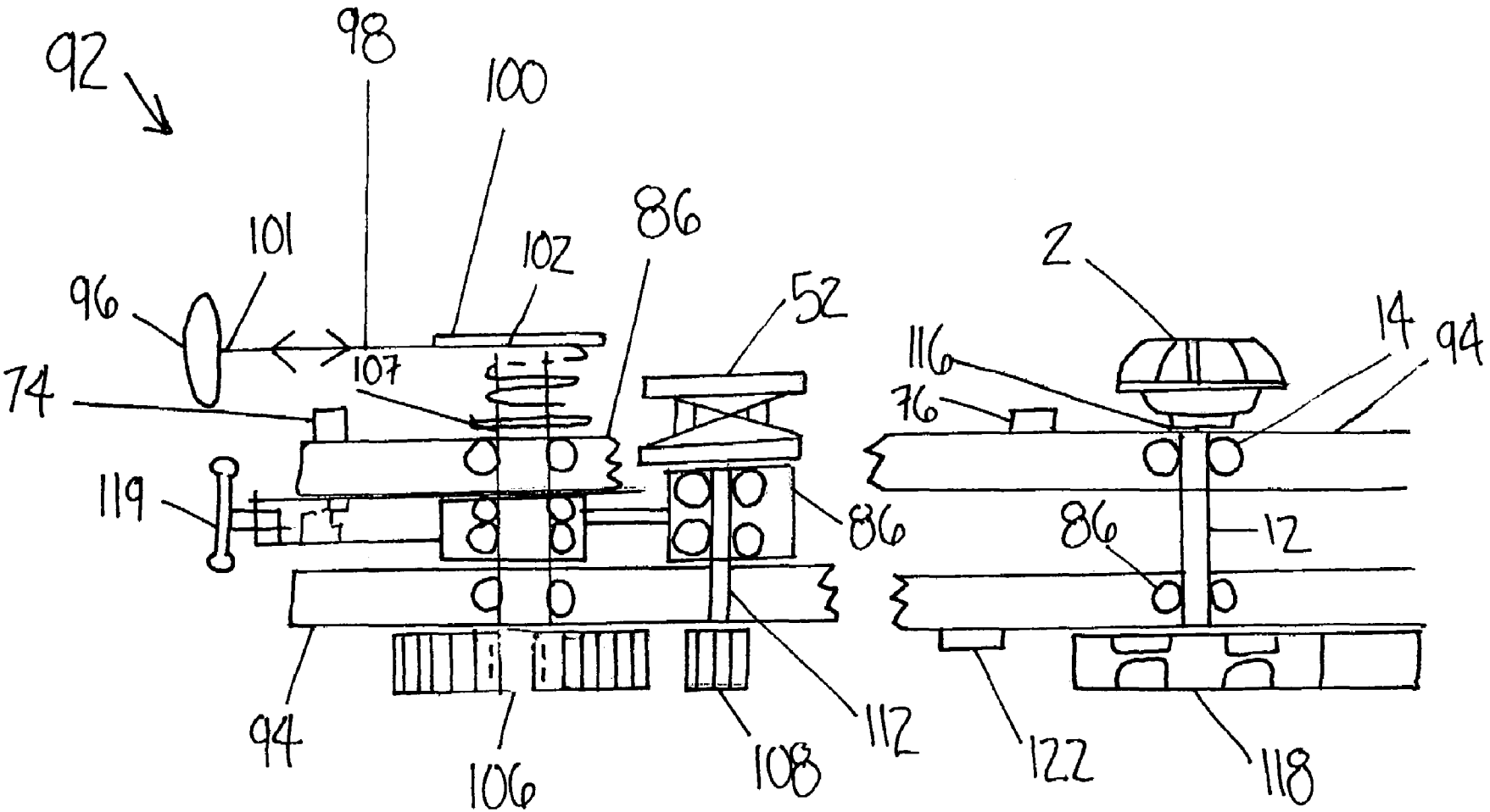
FIG. 4B is a top view illustration of the embodiment of the present invention of FIG. 4A.

Referring now generally to the Figures and particularly to FIGS. 4A and 4B, FIG. 4A is a side view illustration of a still alternate preferred embodiment of the present invention 92, or third version 92. FIG. 4B is a top view of the third version 92 wherein the brake 2 is rotatably coupled with a third frame 94.

In accordance with the additional alternated preferred embodiments of the method of the invention, a user grasps a pulling bar 96 to pull a cable 98 and thereby cause or affect rotary motion of a spool 100. A first an end 101 of the cable 98 is anchored onto the spool 100 and a second end 102 of the cable 98 is anchored onto pulling bar 96. Alternatively, the spool 100 could be driven by foot pedals 30 & 32 or hand pedals (not shown). The spool 100 is rotatably mounted on the third frame 94. The third frame 94 additionally supports a speed increaser timing belt drive 104 (hereafter "belt drive" 104). The belt drive 104 includes a bull gear 106, a bull gear shaft 107, a pinion gear 108, and a drive belt 110. The bull gear shaft 107 mechanically couples the bull gear 106 and the spool 100.

The variable pitch pulley 52 is located at an end of a drive shaft 112. A V belt 114 connects the variable pitch pulley 52 with a housing pulley 116 mounted on the brake housing 4. The shaft 12 of the inner impeller 8 drives a disc 118. The disc 118 acts as an inertial load and in normal use may rotate in either direction. The user controls the resistance of the third version 92 by operating a hand wheel adjustment arm 119 which positions a control bar 120. The movement of the control bar 120 as driven by the hand wheel adjustment arm 119 varies the center distance between the variable pitch pulley 52 and the brake housing 4 and thereby causes a change in speed ratio and tension of the cable 98.

The third version 92 further comprises three motion the first speed sensor 74, the second speed sensor 76, and a third speed sensor 122. These three speed sensors 74, 76 & 122 are communicatively coupled with the computer 70. The first speed sensor 74 monitors the speed and direction of the cable 98. The second speed sensor 76 monitors the speed and direction of the brake housing 4. The third speed sensor 122 monitors the speed and direction of the disc 118. The detections, measurements and/or calculations of the three speed sensors 74, 76 & 122 are substantially continuously sent to the computer 70.

The inner impeller shaft 12 is attached to the disc 118 and rotates freely within the housing bearing 14 (as per FIG. 1) and the ball bearing assemblies 86 whereby the mass of the disc 118 provides resistance to the flow of the liquid medium 6 within the brake 2. Various ball bearing assemblies 86 are configured and applied to support and rotatably couple the brake and other elements of the first, second and third versions 28, 78 & 92 of the present invention. The liquid medium 6 may be light viscosity liquid, oil, or other suitable medium known in the art.

Figure 5:
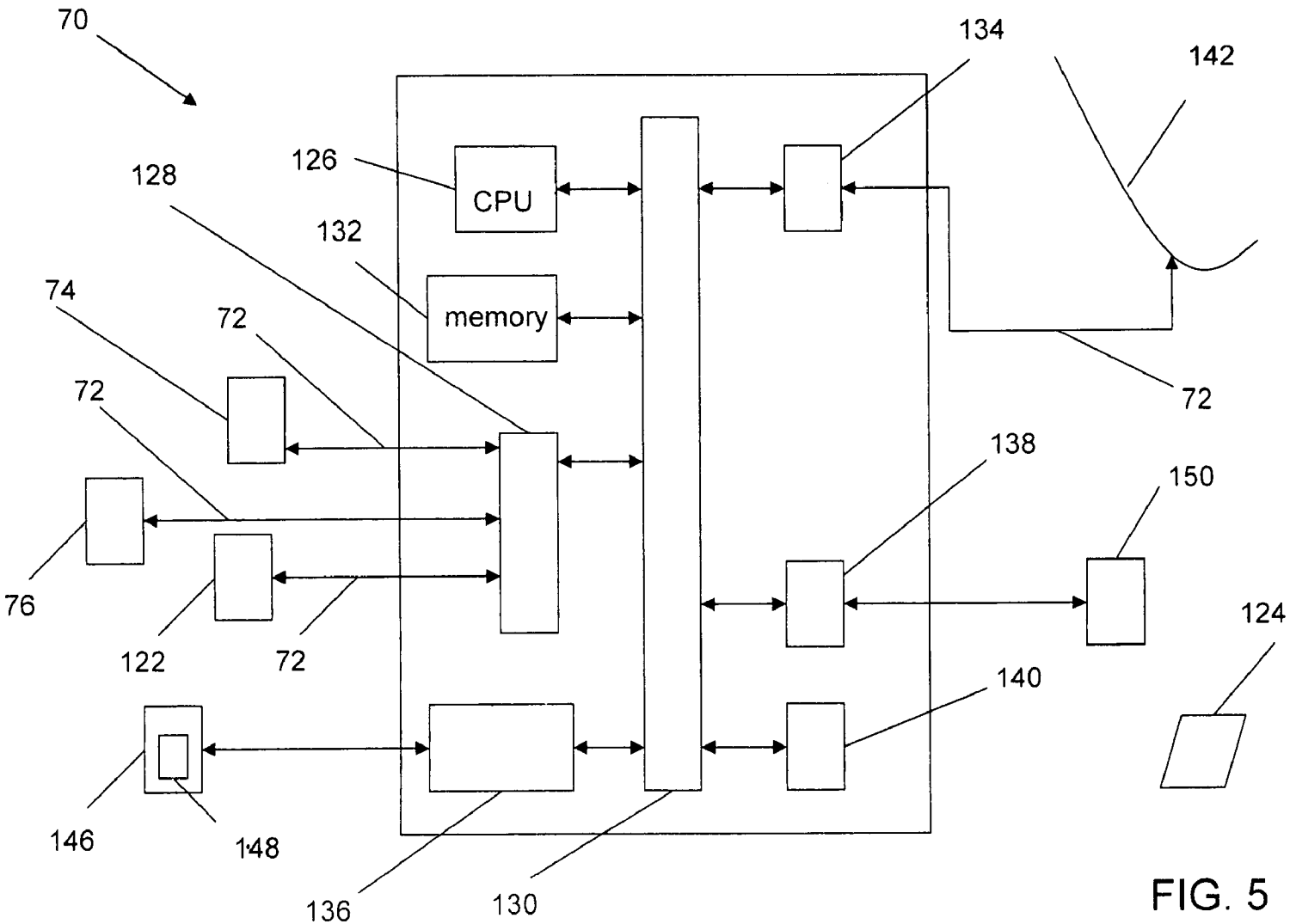
FIG. 5 is a schematic of the computer of FIGS. 2, 3 and 4.

Referring now generally to the Figures and particularly to FIG. 5, FIG. 5 is a schematic drawing of the computer 70 and an electronic medium 124. The computer 70 includes a central processing unit 126, a sensor interface 128, an internal communications bus 130, a system memory 132, a network interface 134, a video device interface 136, an input device interface 138, and an electronic media reader 140. The central processing unit 126 (hereafter "CPU" 126) may be or comprise a PENTIUM ™ microprocessor or other suitable processing unit known in the art. The internal communications bus 130 bi-directionally communicatively couples the central processing unit 126, the sensor interface device 128, the system memory 132, the network interface 134, the video device interface 136, the input device interface 138, and the electronic media reader 140.

The sensor interface 128 is communicatively coupled with the first sensor 74, the second sensor 76, and the third sensor 122 by means of the signal wires 72.

The system memory 132 may store both data structures and executable software programs, and make the stored data structures and software executable programs to the central processing unit 126 via the internal communications bus 130. The network interface 134 is bi-directionally communicatively coupled with an electronics communications network 142 and enables the communications of data from the computer 70 to storage in the electronics communications network 142. The electronics communications network 142 (hereafter "IT network" 142) may comprise the Internet 144 in part or entirely.

The video device interface 136 is bi-directionally communicatively coupled with a display device 146 and enables the visual presentation of information, to include findings from database searches, to be visually presented to a user via a video screen 148 of the visual display device 146.

The input device interface 138 is communicatively coupled with an input device 150 and enables the user to input information and commands and otherwise interact with the computer 70.

The electronic media reader 140 is configured to read and write machine-executable instructions and information to and from the computer-readable medium 124, wherein machine-executable instructions provided by the computer-readable medium 124 may direct the host processor, i.e. CPU 126, to perform one or more of the steps of the method of the present invention. The electronic media reader 140 may further or alternatively write information derived or received from data transmitted by the first, second and third sensors 74, 76 & 122 into the electronic medium 124.

Figure 6:
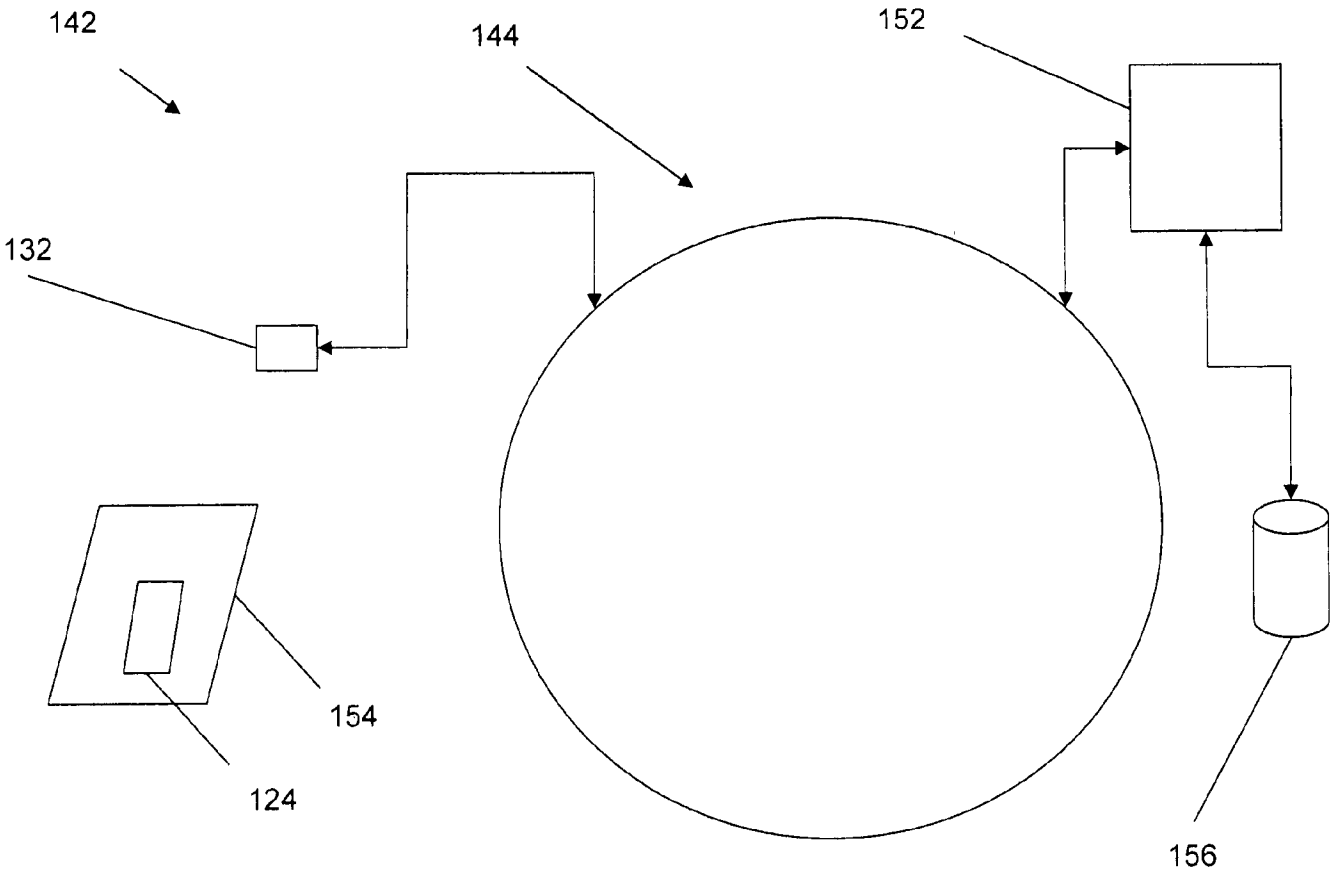
FIG. 6 is an illustration of an information technology system in accordance with the method of the present invention, wherein the rotation of the fluid brake during exercise sessions may be monitored, recorded and associated with the user.

The terms "computer-readable medium" and "computer-readable media" as used herein refer to any suitable medium known in the art that participates in providing instructions or information to an information technology network 142 of FIG. 6 and the computer 70 for execution or storage. Such a medium 124 may take many forms, including but not limited to, non-volatile media, volatile media, and transmission media. Non-volatile media includes, for example, optical or magnetic disks, such as may be comprised within the system memory 132.

Volatile media includes dynamic memory; transmission media includes coaxial cables, copper wire and fiber optics. Transmission media can also take the form of acoustic or light waves, such as those generated during radio wave and infrared data communications.

Common forms of computer-readable media 124 include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium 124 from which a computer system 70 can read machine-executable instructions and/or data.

Various forms of computer readable media 124 may be involved in carrying one or more sequences of one or more instructions to the network 142 for execution. For example, the instructions may initially be carried on a magnetic disk of a remote server 152 (as per FIG. 6). The remote server 152 can load the instructions into its dynamic memory and send the instructions over a telephone line using a modem. A modem local to or communicatively linked with the IT network 142 can receive the data on the telephone line and use an infra-red transmitter to convert the data to an infra-red signal. An infrared detector can receive the data carried in the infrared signal and appropriate circuitry can provide the data to the IT network 142.

In certain additional alternate preferred embodiments of the method of the present invention, the electronic media 124 may be affixed to a portable card 154 that may be sized and shaped to fit into a wallet, such as complying with the form and fit standards of an AMERICAN EXPRESS CARD (™) credit card or other suitable portable electronic media devices known in the art.

Referring now generally to the Figures and particularly to FIG. 6, FIG. 6 is an illustration of the IT network 142 in accordance with the method of the present invention, wherein the rotation of the fluid brake 2 during exercise sessions may be monitored, recorded and associated with the user. The computer 70 may provide data received from or derived from information sourced from the first, second or third sensor 74, 76 & 122 to a data base 156 stored in the server 152 of the IT network 144. The computer 70 may transmit and receive information via the network interface 134 and the Internet 144 and to the server 152.

Alternatively or additionally, information may be communicated between an electronic media reader 132 of the IT network 142 via the Internet 144. Information may then be communicated between the server 152 and the computer 70 by the steps of (1.) writing the information onto the electronic media 124 by the computer 70 or an electronic media reader 132 of the IT network 142; and (2.) reading the information stored in the electronic media 124 by the computer or the electronic media reader 132.

In certain alternate preferred embodiments of the method of the present invention, the server 152 and/or the computer 70 may analyze data received from the exercise equipment, e.g., the first, second or third versions 28, 78 & 92, that includes a hydrokinetic brake 2, and distinguish aerobic from anaerobic exercise on the basis of an observed cadence of exercise and wattage exhibited by an exercise device.

In certain yet additional alternate preferred embodiments of the method of the present invention, the server 152 and/or the computer 70 may be or comprise (1.) a VAIO FS8900 (™) notebook computer marketed by Sony Corporation of America, of New York City, N.Y., (2.) other suitable prior art personal computers known in the art comprising an XP (™) or VISTA (™) personal computer operating system marketed by Microsoft Corporation of Redmond, Wash., and/or (c.) a POWERBOOK (™) personal computer marketed by Apple Computer, Inc., of Cupertino, Calif.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible embodiments of the Present Invention. The examples given should only be interpreted as illustrations of some of the preferred embodiments of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the Present Invention as disclosed and claimed should, therefore, be determined with reference to the knowledge of one skilled in the art and in light of the disclosures presented above.

I claim:

1. An exercise equipment device, the device comprising:

a. A frame and pedals, the pedals rotatably coupled with the frame;

b. A hydro-kinetic coupling, the hydro-kinetic coupling having a housing, with a radial-blade impeller, and a liquid medium, the housing rotatably coupled with the frame and the inner radial-blade impeller affixed to the frame;

c. The housing having a radial-blade impeller and a housing shaft, and the housing containing the liquid medium;

d. A variable ratio transmission, the variable ratio transmission rotatably coupled with the frame and coupled with the housing shaft;

e. A flywheel, the flywheel rotatably coupled with the frame and having an outer diameter and an input shaft;

f. A first drive belt, the first drive belt coupled with the flywheel outer diameter and the variable ratio transmission; and g. A second drive belt, the second drive belt coupled with the flywheel input shaft and pedals, whereby rotation of the pedals is translated into rotation of the housing of the hydro-kinetic coupling.

2. The device of claim 1, wherein the device further comprises an upper body linkage, the upper body linkage coupled with the frame and configured to drive the second drive belt, whereby a user may rotate the housing by moving the pedals or the linkage separately or simultaneously.

3. The device of claim 1, wherein the device further comprises a seat, the seat and frame configured to support a human body.

4. The device of claim 1, wherein the variable ratio transmission comprises variable ratio pulley.

5. The device of claim 1, wherein the device further comprises a computer and a first speed sensor, the first speed sensor communicatively coupled with the computer and the first speed sensor configured to detect a speed of the flywheel and report the detected flywheel speed to the computer.

6. The device of claim 5, wherein the device further comprises a second speed sensor, the second speed sensor communicatively coupled with the computer and the second speed sensor configured to detect a speed of the hydro-kinetic coupling housing and report the detected hydro-kinetic housing speed to the computer, wherefrom the computer calculates the wattage applied to the hydro-kinetic coupling housing.

7. The device of claim 1, wherein the variable ratio transmission comprises an element selected from the group consisting of gearing, a toothed belt, a V belt, and a chain.

8. The device of claim 1, wherein the second belt is a belt selected from the group consisting of gearing, a toothed belt, a V belt, and a chain.

9. An exercise equipment device, the device comprising:

a. A frame and pedals, the pedals rotatably coupled with the frame;

b. A hydro-kinetic coupling, the hydro-kinetic coupling having a housing having radial-blades, an inner radial-blade impeller, and a liquid medium, the housing rotatably coupled with the frame and the inner radial-blade impeller statically affixed to the frame;

c. A variable ratio transmission, the variable ratio transmission rotatably coupled with the frame;

d. A first drive belt, the first drive belt coupled with the variable ratio transmission coupling and the hydrokinetic coupling housing shaft;

e. A flywheel, the flywheel rotatably coupled with the frame and having an outer diameter and a shaft;

f. An intermediate wheel, the intermediate wheel have a shaft, the shaft coupled with the variable speed transmission, and the intermediate wheel configured to be rotated by contact with the outer diameter of the flywheel and to translate rotation of the flywheel into rotation of the variable speed transmission; and g. A second drive belt, the second drive belt coupled with the flywheel shaft and pedals, whereby rotation of the pedals is translated into rotation of the housing of the hydrokinetic coupling.

10. The device of claim 9, wherein the device further comprises a computer and a first speed sensor, the first speed sensor communicatively coupled with the computer and the first speed sensor configured to detect a speed of the flywheel and report the detected flywheel speed to the computer.

11. The device of claim 10, wherein the device further comprises a second speed sensor, the second speed sensor communicatively coupled with the computer and the second speed sensor configured to detect a speed of the hydrokinetic coupling housing and report the detected hydrokinetic housing speed to the computer, wherefrom the computer calculates the wattage applied to the hydro-kinetic coupling housing.

12. The device of claim 9, wherein the variable ratio transmission is an element selected from the group consisting of gearing, a toothed belt, a V belt, and a chain.

13. The device of claim 9, wherein the second drive belt is a belt selected from the group consisting of gearing, a toothed belt, a V belt, and a chain.

14. In an exercise system, the system including a frame and a drive, the drive for translating muscular force of a human body part into an output rotational force, a device comprising:

a. A hydro-kinetic coupling having a housing, an inner radial-blade impeller, and a liquid medium, the housing rotatably coupled with the frame;

b. The housing having a housing radial-blade impeller and the housing containing the liquid medium, the housing coupled with the drive and receiving an output rotational force;

c. The inner radial-blade impeller having a shaft, and the inner radial-blade impeller blade rotatably enclosed within the housing; and d. A disc, the disc coupled with the inner radial-blade impeller shaft, whereby rotation of the inner radial-blade impeller is affected by the mass of the disc.

15. The device of claim 14, wherein the device further comprises a computer and a first speed sensor, the first speed sensor communicatively coupled with the computer and the first speed sensor configured to detect a speed of the flywheel and report the detected flywheel speed to the computer.

16. The device of claim 15, wherein the device further comprises a second speed sensor, the second speed sensor communicatively coupled with the computer and the second speed sensor configured to detect a speed of the hydrokinetic coupling housing and report the detected hydrokinetic housing speed to the computer.

17. The device of claim 16, wherein the device further comprises a third speed sensor, the third speed sensor communicatively coupled with the computer and the third speed sensor configured to detect the speed of the disc and report the detected speed of the disc to the computer, wherefrom the computer calculates the wattage applied to the hydro-kinetic coupling.

18. The device of claim 17, wherein the computer further comprises an output device, the output device for writing the results of calculations of the computer to an electronic media.

19. The device of claim 14, wherein the device further comprises a variable transmission, the variable ratio transmission rotatably coupled with the drive and the hydrokinetic coupling housing, and the variable ration transmission configured to transfer force from the drive to rotational movement of the brake housing.

20. The device of claim 14 or claim 19, wherein the fluid comprises a low viscosity lubricant.

* * * * *